US012680300B2

(12) United States Patent
Safford

(10) Patent No.: US 12,680,300 B2
(45) Date of Patent: Jul. 14, 2026

(54) SYSTEM AND METHOD FOR TENSION BAR GRAVITY SUPPORT FOR GLASS FIN WALL

(71) Applicant: Innovation Glass, LLC, Tivoli, NY (US)

(72) Inventor: Franz Safford, Tivoli, NY (US)

(73) Assignee: Innovation Glass LLC, Tivoli, NY (US)

( * ) Notice: Subject to any disclaimer, the term of this patent is extended or adjusted under 35 U.S.C. 154(b) by 231 days.

(21) Appl. No.: 18/591,247

(22) Filed: Feb. 29, 2024

(65) Prior Publication Data

US 2025/0277365 A1 Sep. 4, 2025

(51) Int. Cl.
*E04B 2/90* (2006.01)

(52) U.S. Cl.
CPC ..... *E04B 2/90* (2013.01)

(58) Field of Classification Search
CPC .... E04B 2/7433; E04B 2/7435; E04B 2/7437; E04B 2/7438; E04B 2002/7446; E04B 2/90; E06B 3/5427
See application file for complete search history.

(56) References Cited

U.S. PATENT DOCUMENTS

| | | | |
|---|---|---|---|
| 2,345,650 | A | 4/1944 | Attwood |
| 2,901,785 | A | 9/1959 | Hinchliffe |
| 2,996,845 | A | 8/1961 | Cipriani et al. |
| 3,052,330 | A | 9/1962 | Hammit et al. |
| 3,053,353 | A | 9/1962 | Miller |
| 3,176,806 | A | 4/1965 | Ferrell |
| 3,266,209 | A | 8/1966 | Jules |
| 3,266,210 | A | 8/1966 | Grossman |
| 3,321,880 | A | 5/1967 | Ferrell et al. |
| 3,478,480 | A | 11/1969 | Swenson |
| 3,548,558 | A | 12/1970 | Grossman |
| 3,561,182 | A | 2/1971 | Madl, Jr. |
| 3,813,120 | A | 5/1974 | Kelly |
| 3,900,996 | A | 8/1975 | Yohe |
| 3,938,297 | A | 2/1976 | Sato et al. |
| 4,031,680 | A | 6/1977 | Stoakes |
| 4,073,113 | A | 2/1978 | Oudot et al. |

(Continued)

FOREIGN PATENT DOCUMENTS

| | | |
|---|---|---|
| CN | 216865635 | 7/2022 |
| DE | 10111246 | 9/2002 |

(Continued)

OTHER PUBLICATIONS

Search Report and Written Opinion for PCT/US2025/016416 (11 pages). (Year: 2025).*

(Continued)

*Primary Examiner* — Rodney Mintz
(74) *Attorney, Agent, or Firm* — Noblitt & Newson, PLLC

(57) ABSTRACT

A glass panel support for use with a glass fin wall and configured to be coupled to a building structure. The glass panel support may comprise an anchor, a tension bar, and a gravity plate. The anchor may be configured to be coupled to the building structure. The tension bar may be coupled to the anchor and extends downwardly therefrom. The gravity plate may comprise a pair of opposing support arms that extend outwardly from the tension bar. The upper surface of the gravity plate is configured to support a portion of the glass panel.

21 Claims, 6 Drawing Sheets

(56) References Cited

U.S. PATENT DOCUMENTS

| | | | | |
|---|---|---|---|---|
| 4,469,198 | A | 9/1984 | Crump | |
| 4,500,572 | A | 2/1985 | Francis | |
| 4,560,130 | A | 12/1985 | Schwartz | |
| 4,568,050 | A | 2/1986 | Radoy et al. | |
| 4,680,905 | A | 7/1987 | Rockar | |
| 4,784,552 | A | 11/1988 | Rebentisch | |
| 4,873,805 | A | 10/1989 | Ting | |
| 4,873,806 | A | 10/1989 | Jeschke | |
| 4,895,331 | A | 1/1990 | Nehls | |
| 4,948,313 | A | 8/1990 | Zankovich | |
| 5,154,385 | A | 10/1992 | Lindberg et al. | |
| 5,209,619 | A | 5/1993 | Rinderer | |
| 5,245,808 | A | 9/1993 | Grunewald et al. | |
| 5,481,839 | A | 1/1996 | Lang et al. | |
| 5,833,417 | A | 11/1998 | Sargent et al. | |
| 5,839,236 | A | 11/1998 | Frey | |
| RE36,681 | E | 5/2000 | Rinderer | |
| 6,086,300 | A | 7/2000 | Frohlich | |
| 6,105,794 | A | 8/2000 | Bauer | |
| 6,401,410 | B2 | 6/2002 | Kenny et al. | |
| 6,484,465 | B2 | 11/2002 | Higgins | |
| 6,588,711 | B2 | 7/2003 | Onishi | |
| 6,598,361 | B2 | 7/2003 | Ting | |
| 6,712,540 | B2 | 3/2004 | Schmalzhofer et al. | |
| 6,827,320 | B2 | 12/2004 | Yeh | |
| 7,004,667 | B2 | 2/2006 | Ludwig et al. | |
| 7,234,566 | B2 | 6/2007 | Simmons | |
| 7,444,781 | B2 * | 11/2008 | Luo | E06B 3/5427 52/204.593 |
| 7,478,504 | B2 | 1/2009 | Huebner et al. | |
| 7,716,891 | B2 | 5/2010 | Radford | |
| 7,818,931 | B2 * | 10/2010 | Grunewald | E04B 2/96 52/844 |
| 8,973,316 | B2 * | 3/2015 | Safford | E04B 2/96 52/235 |
| 9,567,746 | B1 | 2/2017 | Barbulescu et al. | |
| 9,909,309 | B1 | 3/2018 | Conklin | |
| 10,934,706 | B2 * | 3/2021 | Stein | E04D 3/08 |
| 11,952,770 | B2 * | 4/2024 | Taylor | E04B 1/388 |
| 11,982,122 | B2 * | 5/2024 | Condon | E04B 2/96 |
| 12,571,208 | B2 * | 3/2026 | Safford | E04B 2/7435 |
| 2001/0004099 | A1 * | 6/2001 | Onishi | F16B 37/045 248/65 |
| 2001/0011444 | A1 * | 8/2001 | Kenny | E06B 3/5427 52/235 |
| 2002/0124514 | A1 | 9/2002 | Higgins | |
| 2003/0033764 | A1 * | 2/2003 | Ting | E04C 3/32 52/235 |
| 2003/0036314 | A1 * | 2/2003 | Schmalzhofer | F16B 7/187 439/680 |
| 2004/0025459 | A1 | 2/2004 | Huebner et al. | |
| 2004/0033103 | A1 * | 2/2004 | Ludwig | F16B 7/187 403/188 |
| 2004/0155161 | A1 * | 8/2004 | Yeh | A47B 57/565 248/220.22 |
| 2004/0221526 | A1 | 11/2004 | Rinehart et al. | |
| 2005/0034400 | A1 * | 2/2005 | Luo | E06B 3/5427 52/506.01 |
| 2005/0098392 | A1 * | 5/2005 | Simmons | B66B 7/027 187/414 |
| 2005/0284053 | A1 | 12/2005 | Grunewald et al. | |
| 2006/0123722 | A1 | 6/2006 | Stenvall et al. | |
| 2007/0094955 | A1 | 5/2007 | Safford | |
| 2007/0194191 | A1 | 8/2007 | Persson | |
| 2009/0145071 | A1 * | 6/2009 | Radford | E04F 19/061 52/506.08 |
| 2016/0222653 | A1 | 8/2016 | Niehaus et al. | |
| 2018/0283003 | A1 * | 10/2018 | Stein | E04B 2/967 |
| 2023/0038884 | A1 | 2/2023 | Condon et al. | |
| 2023/0243148 | A1 | 8/2023 | Taylor et al. | |
| 2025/0263924 | A1 * | 8/2025 | Safford | E04B 2/7435 |
| 2025/0263925 | A1 * | 8/2025 | Safford | E04B 2/7435 |
| 2025/0297508 | A1 * | 9/2025 | Safford | B21C 23/142 |

FOREIGN PATENT DOCUMENTS

| | | | |
|---|---|---|---|
| EP | 0136431 | A2 | 4/1985 |
| FR | 2585391 | A1 | 1/1987 |
| GB | 2397310 | A | 7/2004 |
| KR | 20110100608 | A | 9/2011 |
| WO | 95/13439 | A1 | 5/1995 |
| WO | 00/45020 | A1 | 8/2000 |
| WO | 2002101166 | A1 | 12/2002 |
| WO | 2004083545 | A1 | 9/2004 |
| WO | 2010063297 | A1 | 6/2010 |

OTHER PUBLICATIONS

Search Report and Written Opinion for PCT/US2025/017148 (9 pages). (Year: 2025).*
Stabalux Brochure, Apr. 1, 2008.
QuadroClad Facades, 2008.
Halfen Channel, Halfen GmBH, Jun. 2022.

* cited by examiner

SYSTEM AND METHOD FOR TENSION BAR GRAVITY SUPPORT FOR GLASS FIN WALL

BACKGROUND OF THE TECHNOLOGY

A variety of systems are used in the construction of buildings. Many of these systems employ a framework, such as in the case of conventional point-supported and conventional glass wall systems. In these systems, panes of glass are attached to, and supported by horizontal mullions, vertical mullions, and glass fin walls. The attachment of glass panels to glass fin walls provides challenges due to the weight of the glass panels. Specifically, the gravity load of the glass panels that attached to glass fin walls may require additional load support.

SUMMARY OF THE TECHNOLOGY

A system and method for the assembly and support of glass panels when used in conjunction with glass fin walls. The system may generally include an anchor, a tension bar and a gravity plate that are suitably adapted for supporting a construction section or glass panel. The anchor, tension bar, and gravity plate may be configured to hold and retain a construction section or glass panel once the system is attached to a building structure.

BRIEF DESCRIPTION OF THE DRAWINGS

A more complete understanding of the present technology may be derived by referring to the detailed description when considered in connection with the following illustrative figures. In the following figures, like reference numbers refer to similar elements and steps throughout the figures. For simplicity and clarity of illustration, elements in the figures are not necessarily drawn to scale.

DETAILED DESCRIPTION OF THE DRAWINGS

The present technology may be described in terms of functional block components and various processing steps.

Such functional blocks may be realized by any number of components configured to perform the specified functions and achieve the various results. For example, the present technology may employ various types of glass fin walls, anchors, bars, plates, glass panels, glass panes, sealing materials, fittings, hangers, fasteners, spacers, walls, and the like, which may carry out a variety of functions. Further, the present technology may employ any number of components for a construction system utilized to support glass panels or panes.

A glass fin wall, also known as a glass fin facade or glass fin system, is a type of architectural feature commonly used in modern building design. A glass fin wall may consist of vertical or horizontal glass panels supported by vertical or horizontal structural elements known as "fins." These fins are typically made of materials like steel, aluminum, or laminated glass and serve several purposes in a building's design.

Glass fin walls may provide structural support when mounting glass panels. Glass fin walls may also distribute the loads and resist wind pressure and other environmental forces. The fins are carefully engineered to ensure the stability and safety of the glass wall.

Glass fin walls are desired in the construction and architectural industry for their sleek and minimalist appearance. They create a transparent or semi-transparent barrier that allows natural light to penetrate interior spaces of buildings and provide a sense of openness and connection with the surrounding environment. Glass fin walls may also provide thermal insulation and reduce heat transfer enhance to the energy efficiency of the building. Additionally, glass fin wall systems may be designed to offer acoustic insulation, helping to reduce noise transmission from the exterior to the interior or vice versa. Depending on the choice of materials and glazing used, glass fin walls may also contribute to sustainable building practices by maximizing natural daylight, reducing the need for artificial lighting, and improving energy efficiency.

Glass fin walls offer a high degree of customization in terms of size, shape, and glass type. This allows architects and designers to create unique and visually striking building facades. As such, glass fin walls are commonly used in commercial buildings, office spaces, retail centers, and even residential architecture. They are often featured in contemporary and modern architectural designs where transparency, aesthetics, and functionality are important considerations.

Various representative implementations of the present technology may be applied to any system for construction. Certain representative implementations may include systems and methods tailored to a specific type of construction, such as point-supported glass wall systems with glass fin walls.

Figure 1:
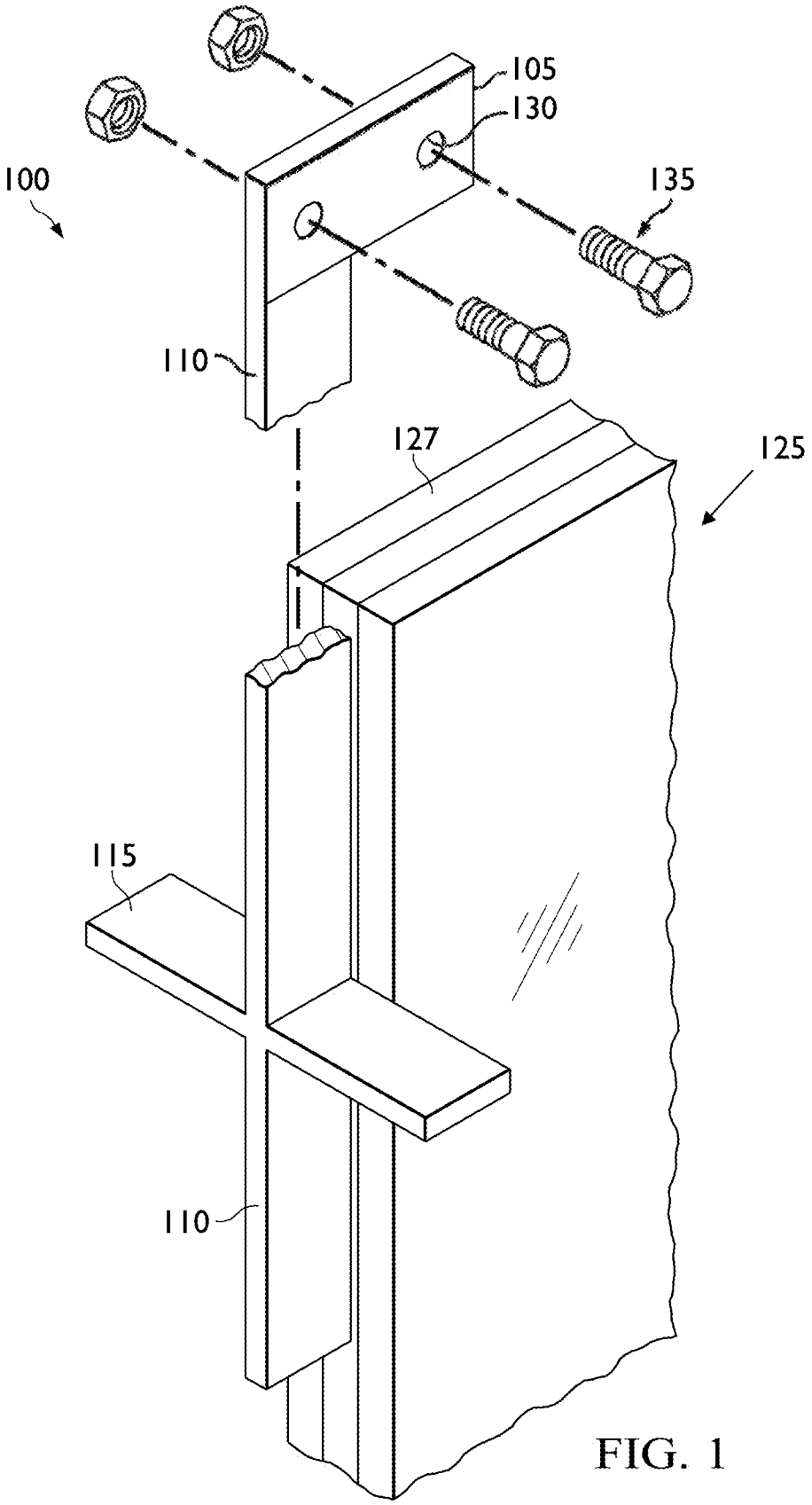
FIG. 1 representatively illustrates an isometric view of a construction assembly system with an anchor, a tension bar and a gravity plate for use with a glass fin in accordance with an exemplary embodiment of the present technology.
Figure 2:
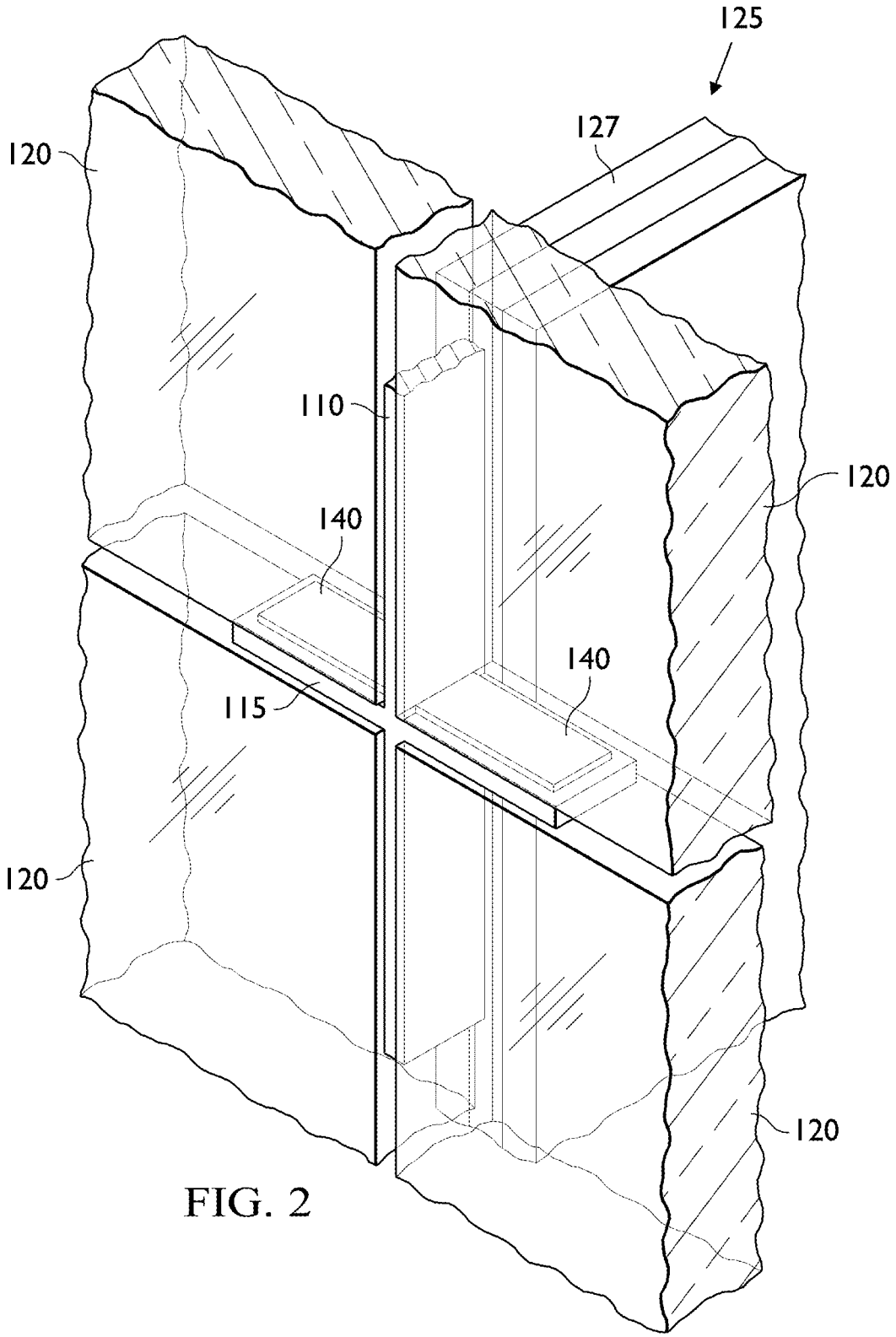
FIG. 2 representatively illustrates a front isometric view of a construction assembly with the tension bar and gravity plate supporting a plurality of glass panels that are connected to a glass fin in accordance with an exemplary embodiment of the present technology.

Referring now to FIGS. 1 and 2, a glass panel support system 100 generally comprises an anchor 105, a tension bar 110, and a gravity plate 115 that are suitably adapted for supporting a construction section or glass panel 120. The anchor 105, tension bar 110, and gravity plate 115 may be configured to hold and retain a construction section or glass panel 120 once the glass panel support system 100 is attached to a building structure (not shown). The anchor 105, tension bar 110, and gravity plate 115 may be a single unitary piece or may be multiple pieces welded together or otherwise attached.

The glass panel support system 100 may be used in conjunction with a glass fin wall 125 and attached to any suitable known building structure such as, a beam, floor, column, floor slab, and the like. The glass panel support system 100 may be coupled to the building structure by the anchor 105. The glass panel support 100 may be made from steel, stainless steel, and the like.

The glass panel support system 100 allows the glass panels to be supported by the building structure, and not the glass fin walls thereby decoupling the dead/gravity loads of the glass panels 120 from transferring to the glass fin wall 125, which results in reduced size glass fins walls, thereby reducing the costs. The glass panel support system 100 also eliminates the need for any exposed metal gravity shelf brackets to be bolted to a glass fin wall, thus further eliminating the requirement of holes to be drill in the glass fins, which increases the cost of the glass façade.

The anchor 105 may comprise a plate with at least one aperture 130 for coupling to the building structure. In one embodiment, the anchor 105 may comprise a pair of apertures 130 that receive fasteners 135, which are adapted to couple the anchor 105 to the building structure. The fasteners 135 may comprise any suitable configuration for coupling the anchor 105 to the building structure. In one embodiment, the fasteners 135 may comprise a nut and bolt configuration.

The tension bar 110 extends vertically downward from the anchor 105. In one embodiment the tension bar 110 is oriented at generally a right angle with respect to a lower surface of the anchor 105. The centerline of the tension bar 110 is generally aligned with the centerline of the glass fin wall 125. The gravity plate 115 may comprise a pair of support arms that extend generally horizontally from the tension bar 110. In one embodiment, the gravity plate 115 is oriented at generally a right angle with respect to the sides of the vertically disposed tension bar 110. The tension bar 110 and gravity plate 115, when assembled, create a cross shape that is configured to support glass panels and be completely concealed, once installed. In one embodiment the anchor 105 is in the z-axis and is perpendicular to the tension bar 110 (which is in the x-axis) and the gravity plate (which is in in the x-axis).

Figure 3:
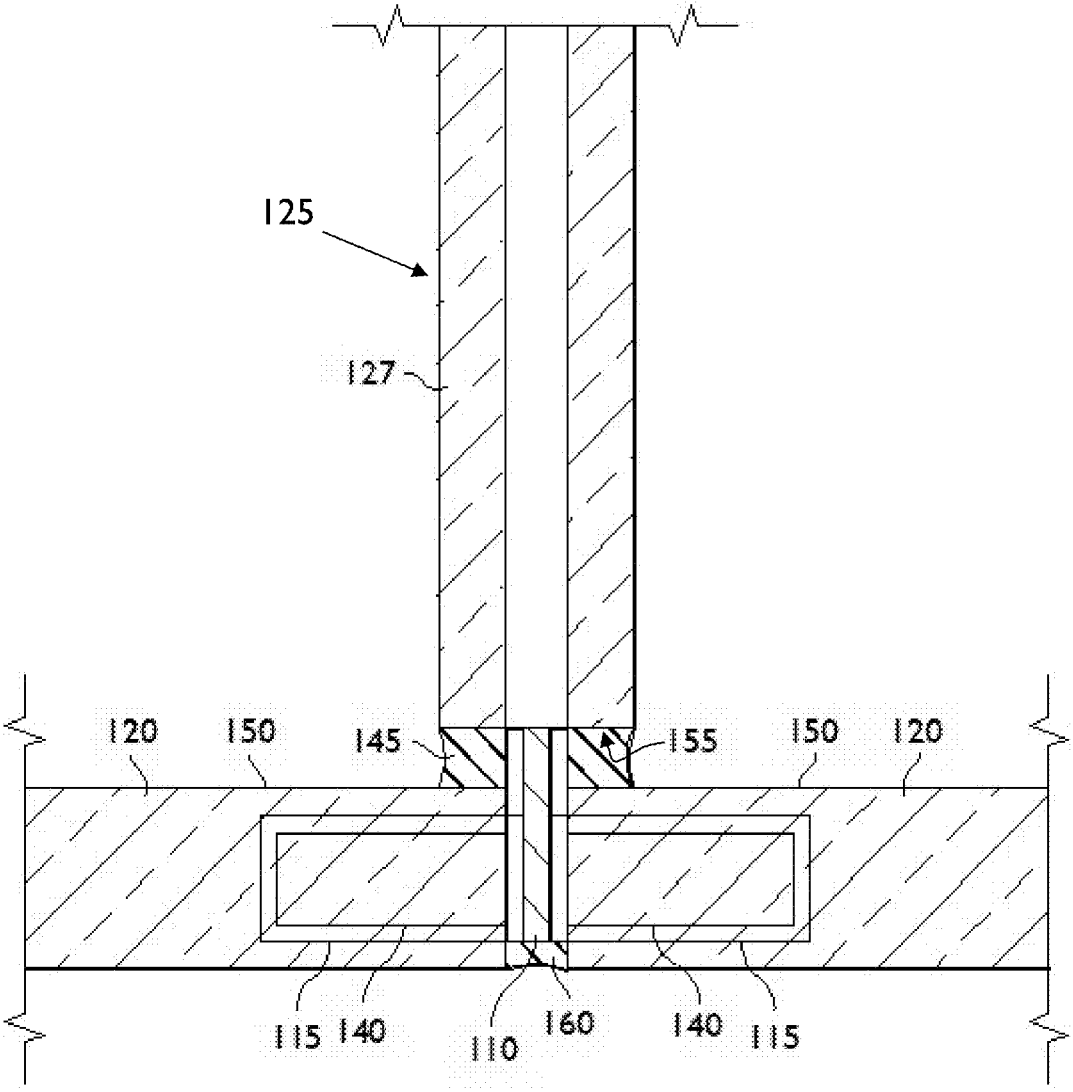
FIG. 3 representatively illustrates a top, cross-sectional view of a construction assembly with the tension bar and gravity plate supporting a plurality of glass panels that are connected to a glass fin and supporting a plurality of glass panels in accordance with an exemplary embodiment of the present technology.
Figure 4:
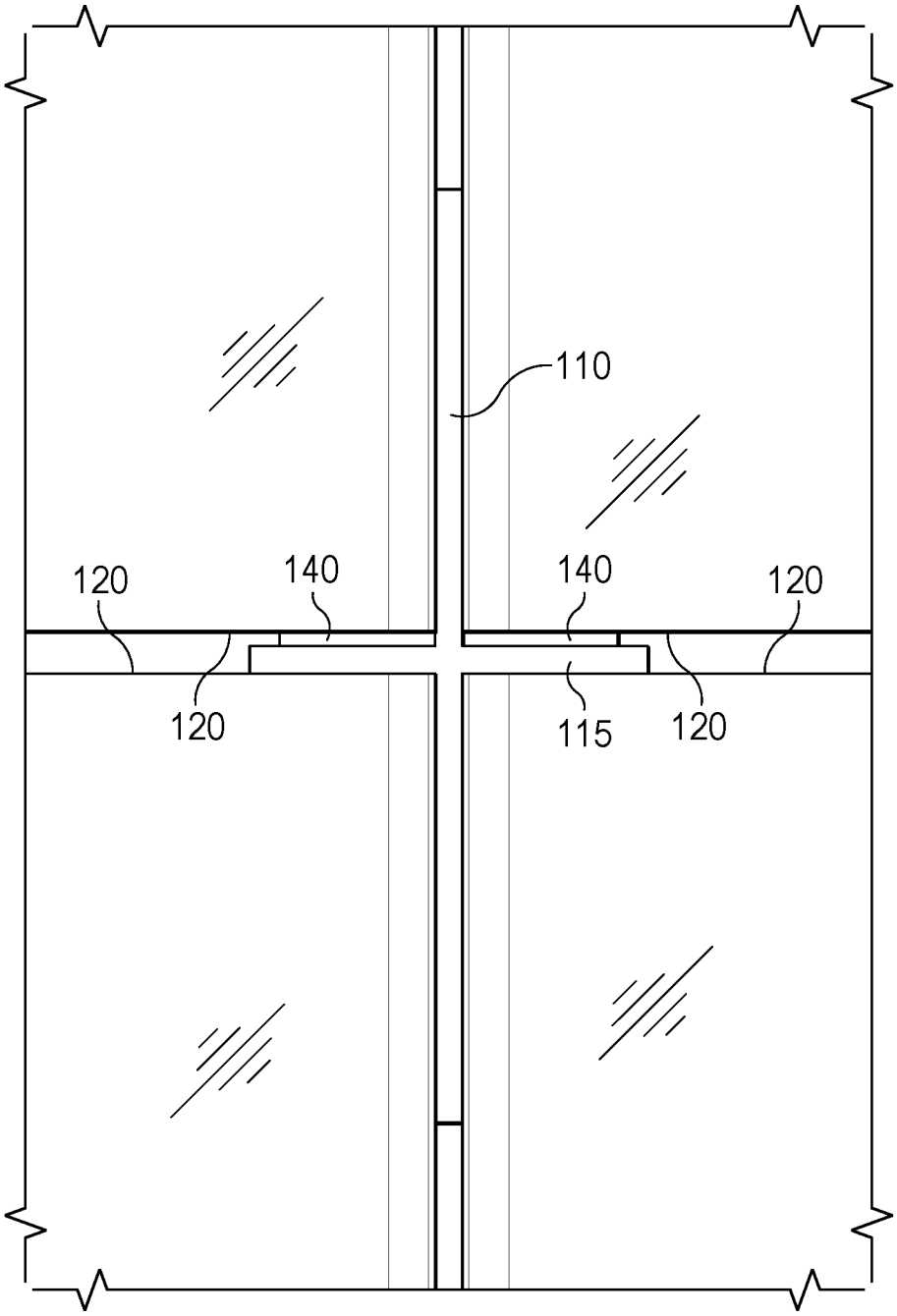
FIG. 4 representatively illustrates a front view of the tension bar and gravity plate supporting a plurality of glass panels in accordance with an exemplary embodiment of the present technology.
Figure 5:
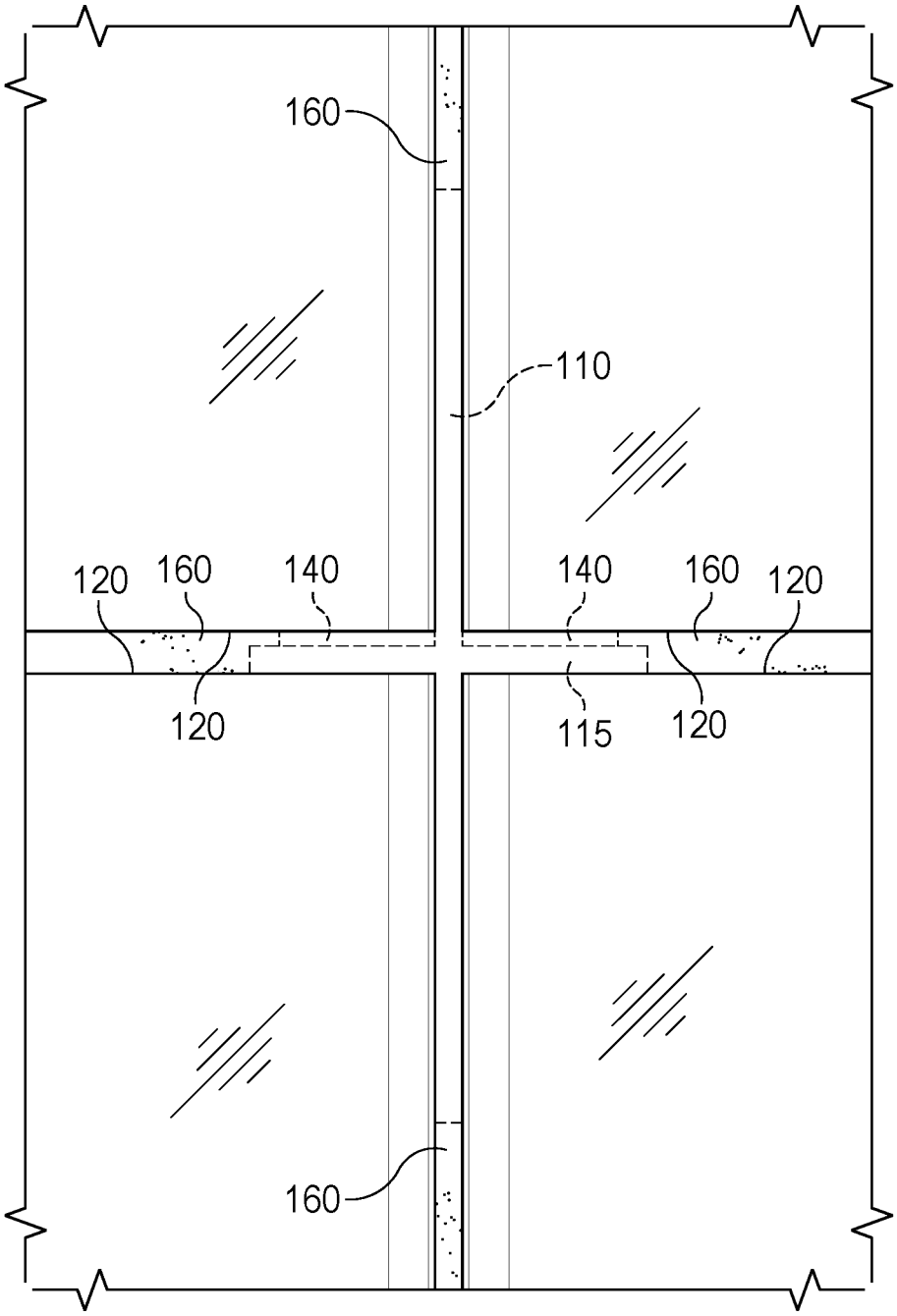
FIG. 5 representatively illustrates a front view of the tension bar and gravity plate supporting a plurality of glass panels with sealant added thereto in accordance with an exemplary embodiment of the present technology.

As shown in FIGS. 2-5, the gravity plate 115 supports the glass panels 120 once installed. The glass panels 120 may rest on an elastomeric pad 140, which supports and protects the glass panel 120 residing on the gravity plate 115. The elastomeric pad 140 prevents the glass panel 120 from contacting the gravity plate 115. The elastomeric pad may cover all or a portion of the surface of the gravity plate 115. The elastomeric pad 140 may be comprised of any suitable elastomeric material, for example, silicone, and the like. FIG. 4 shows an exterior view of the glass panels 120 installed and FIG. 5 shows an exterior view of the glass panels 120 installed with weather protection material applied thereto.

Figure 6:
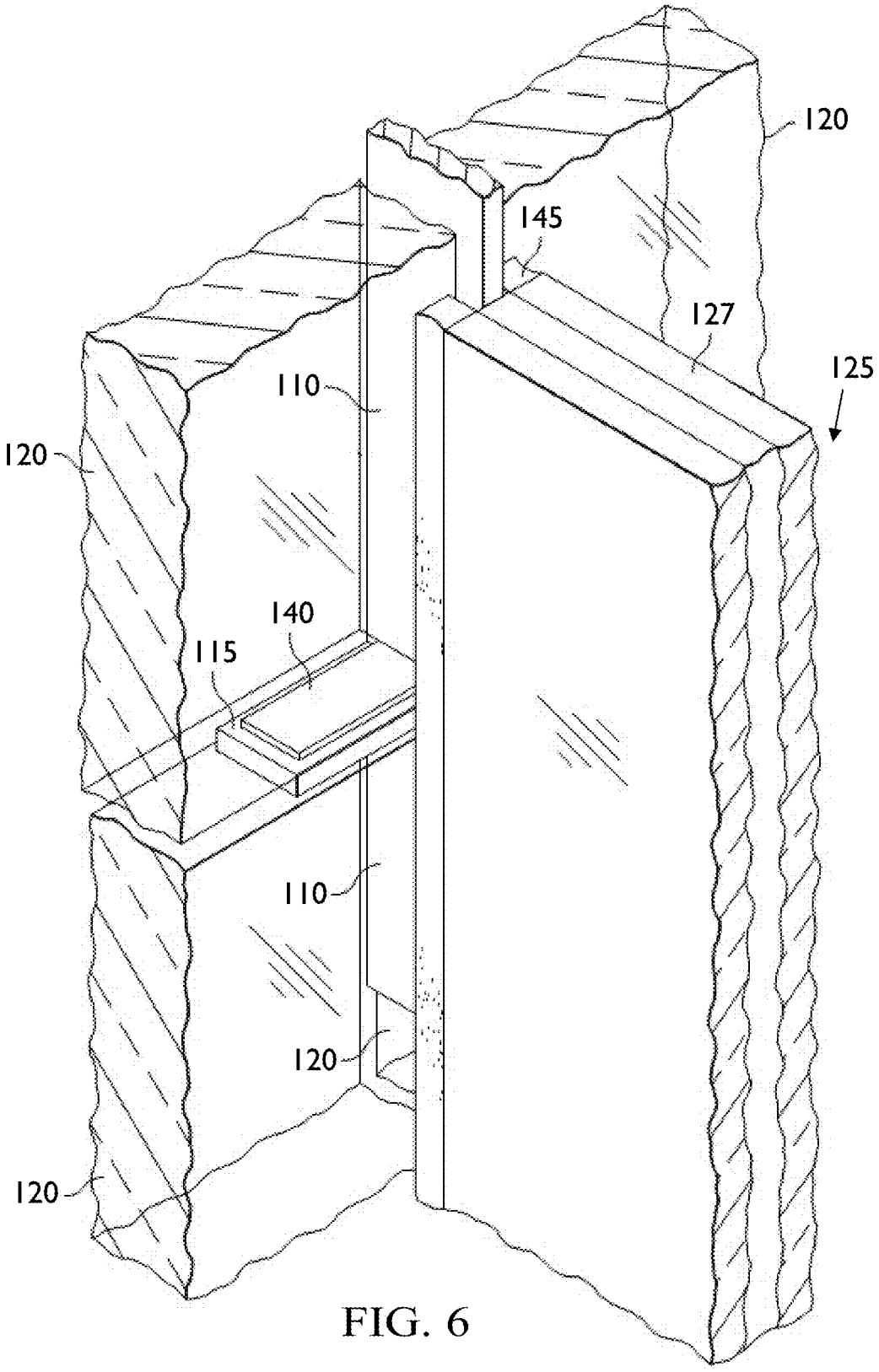
FIG. 6 representatively illustrates a rear isometric view of a construction assembly with the tension bar and gravity plate supporting a plurality of glass panels that are connected to a glass fin in accordance with an exemplary embodiment of the present technology.

As shown in FIGS. 3 and 6, a structural elastomer 145 may be applied to connect an inner surface 150 of the glass panel 120 to a front facing surface 155 of a glass fin 127 of the glass fin wall 125. The structural elastomer 145 may be glued or otherwise attached to the inner surface 150 of the glass panel 120 and to a front facing surface 155 of the glass fin 127. As shown in FIG. 5, once installed, a seal 160 is added to the spaces between the glass panels 120 to weatherproof the glass panel support system 100 and disallow any foreign materials to penetrate the outer surface of the installed glass panels 120.

In a construction system according to various aspects of the present technology, mullions may be attached to the structure of a building to provide a framework for supporting construction sections. Suitably configured fittings may be attached to the glass fin walls to provide point-supported or continuously supported retention of construction sections. Construction systems in accordance with various exemplary embodiments of the present technology may be used to build any type of structure, such as a point-supported glass wall, for example. The construction system may also be used to achieve various aesthetic benefits. For example, the panes of glass used to form a glass wall will generally be displaced away from the mullions, making it more difficult to see the mullions from an exteriorly disposed vantage point. Additionally, construction systems in accordance with the present technology may be used to achieve any structural benefit, whether now known or hereafter described in the art, such as the ability to construct a multi-story point-supported glass wall system using substantially vertically-aligned mullions without the need for horizontally-aligned mullions.

Constructs (i.e., construction designs) that may be realized via implementation of various embodiments of the present technology shall be understood to comprise anything that may be at least partially assembled from at least one or more component parts, such as, for example: a window; a wall; a partition; a frame; a panel; a covering; a dome; a door; a display case; a display wall; a display frame; a cubicle; a presentation display; a booth; an enclosure; a temporary habitat; a mobile home; a video device array; various architectural construction elements; and/or the like.

A 'construction section' shall be understood to comprise any component part of a construct surface, such as, for example, a pane of glass, a panel of wood, a sheet of drywall, a graphite board, Plexiglas, Lucite, a video device element, etc. Furthermore, a construction section may comprise any two-dimensional (e.g., substantially planar) or three-dimensional (e.g., polyhedral, spherical, hemispherical, elliptical, parabolic, etc.) geometry and/or any combination thereof.

In the foregoing description, the technology has been described with reference to specific exemplary embodiments. Various modifications and changes may be made, however, without departing from the scope of the present technology as set forth. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any appropriate order and are not limited to the explicit order presented in the specific examples. Additionally, the components and/or elements recited in any system embodiment may be combined in a variety of permutations to produce substantially the same result as the present technology and are accordingly not limited to the specific configuration recited in the specific examples.

Benefits, other advantages and solutions to problems have been described above with regard to particular embodiments. Any benefit, advantage, solution to problems or any element that may cause any particular benefit, advantage or solution to occur or to become more pronounced, however, is not to be construed as a critical, required or essential feature or component.

As used herein, the terms "comprises," "comprising," or any variation thereof, are intended to reference a non-exclusive inclusion, such that a process, method, article, composition or apparatus that comprises a list of elements does not include only those elements recited but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same. Any terms of degree such as "generally," "substantially," "about," and "approximate" as used herein mean a reasonable amount of deviation of the modified term such that the end result is not significantly changed. For example, these terms can be construed as including a deviation of at least ±5% of the modified term if this deviation would not negate the meaning of the word it modifies.

The present technology has been described above with reference to an exemplary embodiment. However, changes and modifications may be made to the exemplary embodiment without departing from the scope of the present technology. These and other changes or modifications are intended to be included within the scope of the present technology.

The invention claimed is:

1. A glass panel support configured to be coupled to a building structure and to support a glass panel comprising:
- a glass fin wall comprising a glass fin;
- an anchor configured to be coupled to the building structure;
- a tension bar coupled to the anchor and extending downwardly therefrom;
- a gravity plate comprising a pair of opposing support arms that extend outwardly from the tension bar, wherein an upper surface of the gravity plate is configured to support a portion of the glass panel; and
- a structural elastomer coupled to and connecting an inner surface of the glass panel to a front facing surface of the glass fin wall.

2. The glass panel support of claim 1, further comprising an elastomeric pad coupled to the upper surface on the support arms of the gravity plate and configured to support at least a portion of the glass panel.

3. The glass panel support of claim 1, wherein the support arms of the gravity plate and the tension bar form a cross shape.

4. The glass panel support of claim 1, wherein the gravity plate and the tension bar support at least a portion of a pair of glass panels.

5. The glass panel support of claim 1, wherein the tension bar coupled to the anchor only extends downwardly therefrom.

6. The glass panel support of claim 1, wherein a front surface of the anchor and a front surface of the tension bar are co-planar.

7. The glass panel support of claim 1, wherein a vertical centerline of the anchor and vertical centerline of the tension bar are in same vertical plane.

8. The glass panel support of claim 1, wherein the anchor and the tension bar have same vertical axis.

9. The glass panel support of claim 1, wherein a vertical axis of the anchor and a vertical axis of the tension bar are aligned in same plane.

10. The glass panel support of claim 1, wherein the support arms of the gravity plate extend substantially horizontally away from an outer surface of the tension bar in opposite directions.

11. The glass panel support of claim 10, wherein the support arms of the gravity plate extend substantially horizontally from the tension bar and are oriented at substantially a right angle from the outer surface of the tension bar.

12. The glass panel support of claim 1, wherein the anchor is coupled to the building structure by at least one fastener and extends substantially horizontally away from the building structure.

13. The glass panel support of claim 12, wherein the tension bar extends substantially vertically downwardly from the anchor.

14. The glass panel support of claim 13, wherein the tension bar extends substantially vertically downwardly from the anchor substantially at a right angle from a lower surface of the anchor.

15. The glass panel support of claim 1, wherein the anchor is oriented in the z-axis.

16. The glass panel support of claim 15, wherein the tension bar is oriented in the y-axis.

17. The glass panel support of claim 16 wherein the anchor is perpendicular to the tension bar.

18. The glass panel support of claim 16, wherein the gravity plate is oriented in the x-axis.

19. The glass panel support of claim 18, wherein the gravity plate is perpendicular to the tension bar.

20. A glass panel support configured to be coupled to a building structure and to support a glass panel comprising:
- a glass fin wall comprising a glass fin;
- an anchor configured to be coupled to the building structure;
- a tension bar coupled to the anchor, oriented perpendicular thereto, and extending downwardly therefrom;
- a gravity plate comprising a pair of opposing support arms oriented perpendicular thereto that extend outwardly from the tension bar, wherein an upper surface of the gravity plate is configured to support a portion of the glass panel; and
- a structural elastomer coupled to and connecting an inner surface of the glass panel to a front facing surface of the glass fin wall.

21. The glass panel support of claim 20, further comprising an elastomeric pad coupled to the upper surface on the support arms of the gravity plate and configured to support at least a portion of the glass panel.

* * * * *